United States Patent [19]

Stich et al.

[11] Patent Number: 4,789,130

[45] Date of Patent: Dec. 6, 1988

[54] CONTAINER AND ICE CUBE TRAY ASSEMBLY

[75] Inventors: Richard A. Stich; William J. Armstrong, both of Louisville, Ky.

[73] Assignee: General Electric Company, Louisville, Ky.

[21] Appl. No.: 58,859

[22] Filed: Jun. 5, 1987

[51] Int. Cl.[4] ..... F25C 1/24

[52] U.S. Cl. ..... 249/120; 62/344; 206/501; 206/511; 220/23.83; 220/66; 220/74; 249/126; 249/127; 249/132

[58] Field of Search ..... 249/69, 120, 126, 127, 249/129, 132, 205, 203; 62/344; 206/501, 503, 511, 507, 509; 220/23.83, 66, 74, 83

[56] References Cited

U.S. PATENT DOCUMENTS

| | | | |
|---|---|---|---|
| D. 133,867 | 9/1942 | Chaplin | D67/3 |
| D. 204,521 | 4/1966 | Kelley, Jr. | D67/3 |
| D. 206,631 | 1/1967 | Howitt | D67/3 |
| D. 219,483 | 12/1970 | Doman et al. | D67/3 |
| D. 239,875 | 5/1976 | Armstrong | D67/3 B |
| 2,049,934 | 8/1936 | Witherspoon | 62/344 |
| 2,067,830 | 1/1937 | Depew | 62/1 |
| 2,634,020 | 4/1953 | Bartholomew | 220/74 |
| 3,256,975 | 6/1966 | Puente | 206/328 |
| 3,259,269 | 7/1966 | Asenbauer | 206/509 |
| 3,416,704 | 12/1968 | Frater | 206/509 |
| 3,545,717 | 12/1970 | Pietrzak | 249/69 |
| 3,653,224 | 4/1972 | Tsen | 62/344 |
| 3,670,523 | 6/1972 | Fogt et al. | 62/344 |
| 3,803,868 | 4/1974 | Tunzi et al. | 62/344 |
| 4,015,713 | 4/1977 | Clipson et al. | 206/509 |
| 4,442,969 | 4/1984 | Holden | 220/72 |

FOREIGN PATENT DOCUMENTS

| | | | |
|---|---|---|---|
| 241141 | 6/1960 | Australia | 206/509 |
| 570805 | 9/1958 | Belgium | 206/509 |
| 1279410 | 11/1961 | France | 206/509 |

*Primary Examiner*—Jay H. Woo
*Assistant Examiner*—James Housel
*Attorney, Agent, or Firm*—Frederick P. Weidner; Radford M. Reams

[57] ABSTRACT

A container and ice cube tray assembly to store a plurality of relatively small similarly shaped items with easy user manual access. The container has a corrugated bottom wall and two spaced apart side walls integrally connected to the bottom wall and terminating at the top thereof in an outwardly directed flange. Located near the junction of the side walls and outwardly directed flanges is a longitudinal groove extending therealong. The container has two spaced apart end walls, said end walls integrally connected to the bottom and side walls and extend up the side walls a substantial distance and each has a terminal end extending in a horizontal plane parallel to the bottom wall the full width of the container to allow user manual access from either end of the container to the small items stored in the container. The end walls have a flange extending outwardly from the terminal ends and the side walls have outwardly directed flanges connecting the end wall flanges and the top flanges of the side walls to rigidify the container.

7 Claims, 3 Drawing Sheets

CONTAINER AND ICE CUBE TRAY ASSEMBLY

BACKGROUND OF THE INVENTION

This invention relates to a utility container and particularly a container for use in a household refrigerator that can be used for either storing eggs or ice cubes depending upon the desires of the user. It is common practice to utilize egg containers in a refrigerator wherein the eggs are stored in a separated manner so that the cold air of the refrigerator may circulate freely around the eggs and enhance refrigeration of the eggs. Such a container for eggs is shown in U.S. Pat. No. Des. 239,875, assigned to the same assignee as the present invention It is also common to have an ice cube bin or container for storage of ice cubes in the freezer compartment of a refrigerator and such ice cube containers are shown in U.S. Pat. Nos. Des. 219,483 and 206,631.

It is desirable in many cases that a dual purpose container be available to the user of a refrigerator so that the user can use the container to store relatively small similarly shaped items such as ice cubes in the freezer compartment of the refrigerator or eggs in the fresh food compartment. Such a container needs to have a structural arrangement that is satisfactory for such uses depending upon which the user desires.

By this invention there is provided a utility container that may be used for the storage of ice cubes in the freezer compartment of a refrigerator or the storage of eggs in the fresh food compartment or other relatively small similarly shaped items.

SUMMARY OF THE INVENTION

There is provided a container to store a plurality of relatively small similarly shaped items with easy user manual access. The container has a corrugated bottom wall and two spaced apart side walls integrally connected to the bottom wall and terminating at the top thereof in an outwardly directed flange and located near the junction of each side wall and outwardly directed flange is a longitudinal groove extending therealong. The container also has two spaced apart end walls which are integrally connected to the bottom and side walls and extend up the side walls a substantial distance and each has a terminal end extending in a horizontal plane parallel to the bottom wall the full width of the container to allow user manual access from either end of the container to the small items stored in the container. The end walls each have a flange extending outwardly from the terminal ends and the side walls have outwardly directed flanges connecting the end wall flanges and the top flanges of the side walls to rigidify the container.

DESCRIPTION OF THE PREFERRED EMBODIMENT

Figure 1:
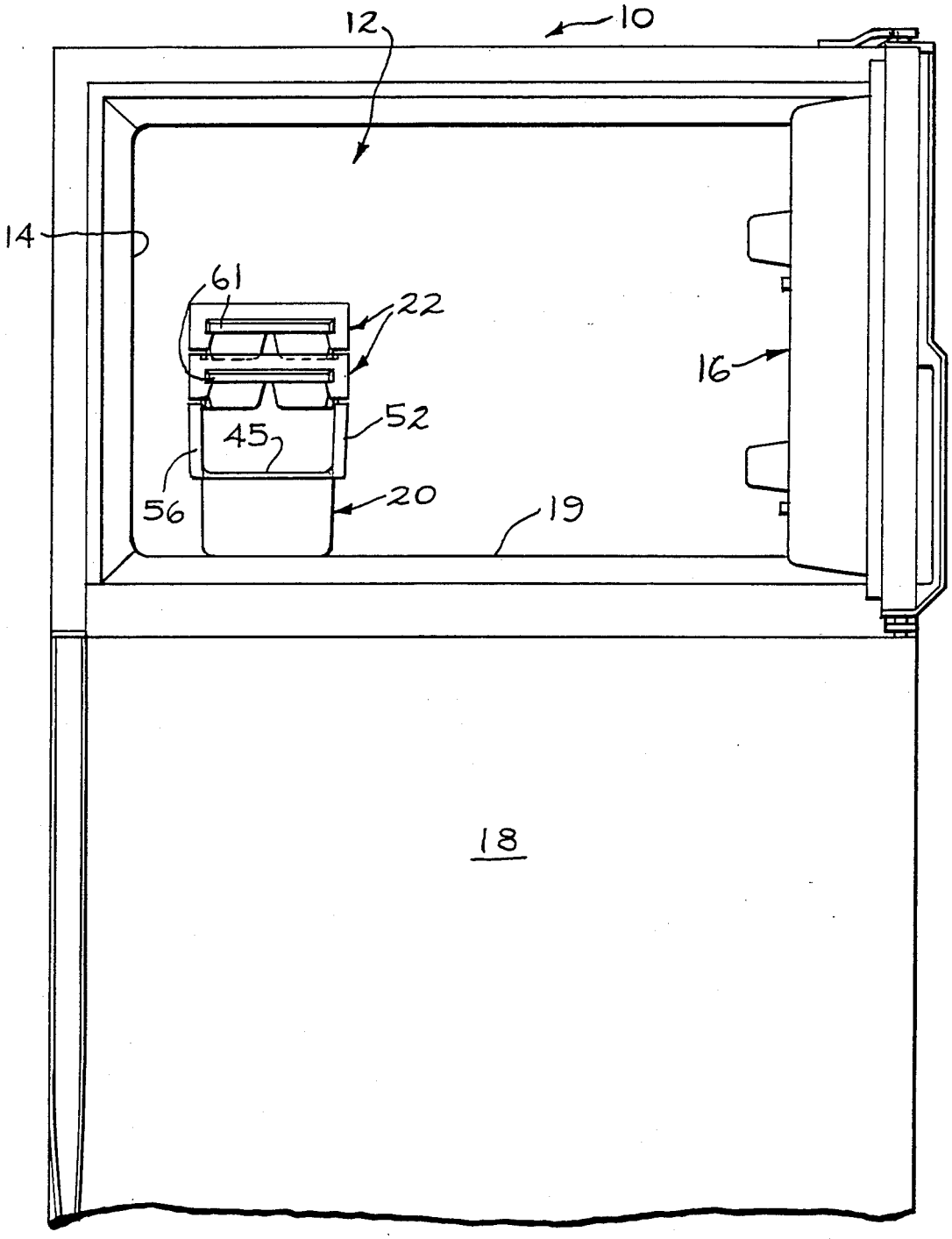
FIG. 1 is a side elevational view of a household refrigerator having the freezer compartment access door open and showing the utility container of the present invention.

With reference to FIG. 1, there is shown a refrigerator cabinet 10 having a freezer compartment 12 with an access opening 14 and a hinged access door 16 shown in its open position. Below the freezer compartment 12 is a fresh food compartment with an access door 18 shown in a closed position. Inside the freezer compartment 12 supported on the floor 19 thereof is shown the utility container 20 of the present invention having two identical ice cube trays 22 stacked one on top of the other and supported by the top of the utility container 20.

Figure 2:
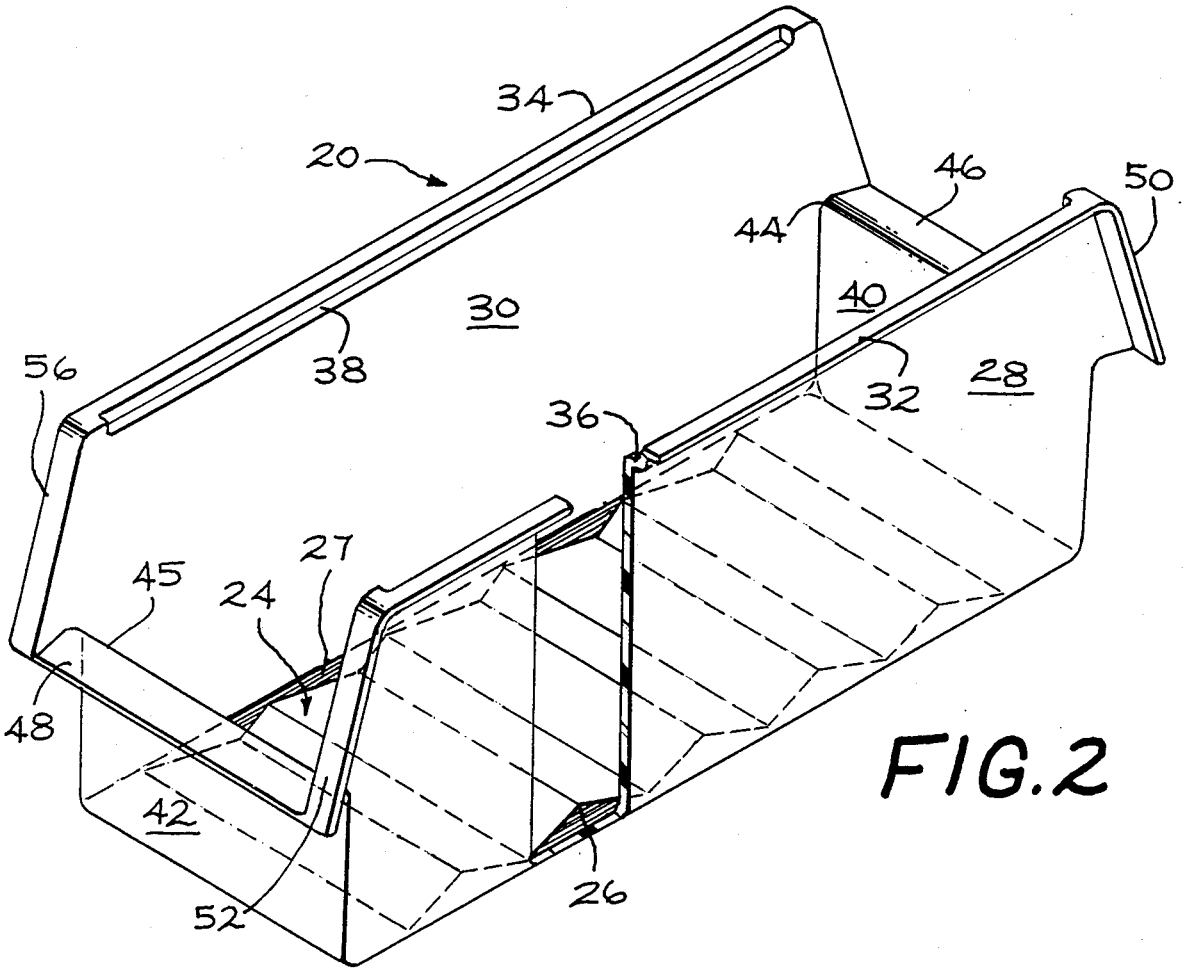
FIG. 2 is a perspective view of the utility container of the present invention.

With particular reference to FIG. 2, the structural arrangement of the utility container 20 is shown in perspective. The utility container has a rippled or corrugated bottom wall 24 which has a plurality of wide angle inverted V-shaped sections formed integrally as part of the bottom wall 24. The apex of the inverted V-shaped sections are spaced from each other and are corrugations 26. The bottom wall has a bottom outer peripheral surface 27 in a horizontal plane that acts as a base to support the container when placed on a surface and the corrugations 26 are located within and above the bottom outer peripheral surface. There are two spaced apart side walls 28 and 30 integrally connected to the bottom wall 24 and terminating at the top thereof in outwardly directed flanges 32 and 34 respectively. Located near the junction and in the preferred embodiment at the junction of the side walls 28 and 30 and the outwardly directed flanges 32 and 34 respectively are longitudinal grooves 36 and 38 respectively which extend therealong. The utility container 20 has two spaced apart end walls 40 and 42 which are integrally connected to the bottom wall 24 and side walls 28 and 30 and extend up the side walls a substantial distance and in the preferred embodiment approximately mid-way and each have a terminal end 44 and 45 respectively, both of which extend in a horizontal plane parallel to the bottom wall 24 the full width of the container 20 to allow user manual access from either end of the container to the small items stored in the container. The end walls 40 and 42 each have a flange 46 and 48 respectively extending outwardly from the terminal ends 44 and 45 respectively. The side wall 28 has a side wall flange 50 at one end thereof and a side wall flange 52 at the opposite end thereof and side wall 30 has a side wall flange 54 (FIG. 4) at one end thereof and a side wall flange 56 at the opposite end thereof. The upper portion of the side walls 28 and 30 and the flanges 50, 52, 54 and 56 connecting the end wall flanges 46 and 48 to the top flanges 32 and 34 of the side walls are upwardly and inwardly directed from the end wall flanges 46 and 48. These side wall flanges connect the end wall flanges 46 and 48 respectively and the top flanges 32 and 34 of the side walls. With this structure the container is rigidified even though the end walls 40 and 42 terminate mid-way up along the side walls.

Figure 3:
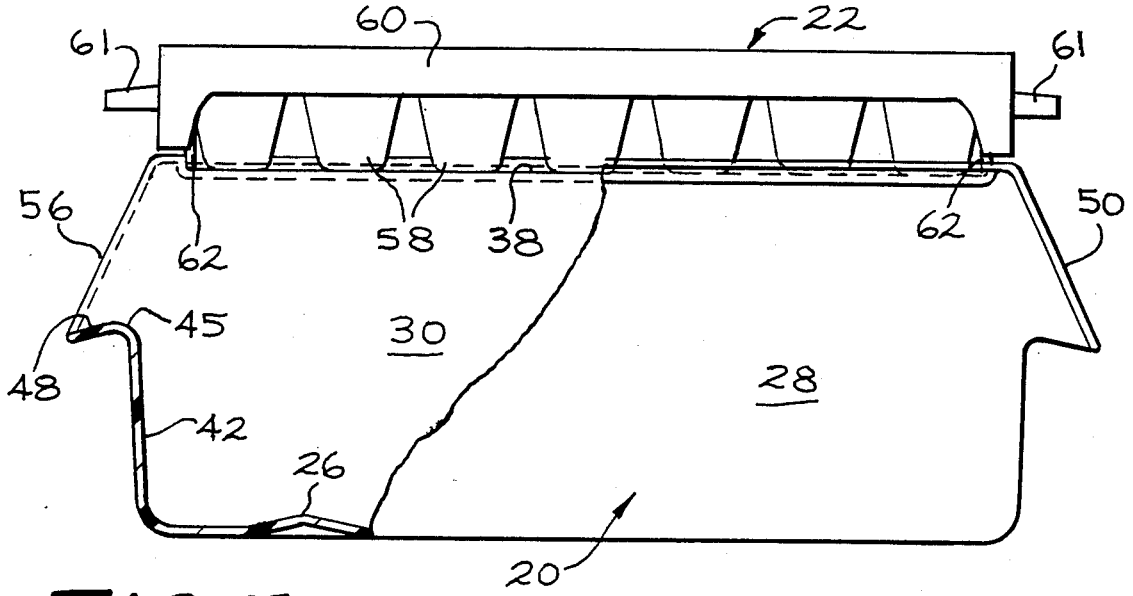
FIG. 3 is a side elevational view partially in section showing the utility container of the present invention with an ice cube tray supported on top of the container.
Figure 4:
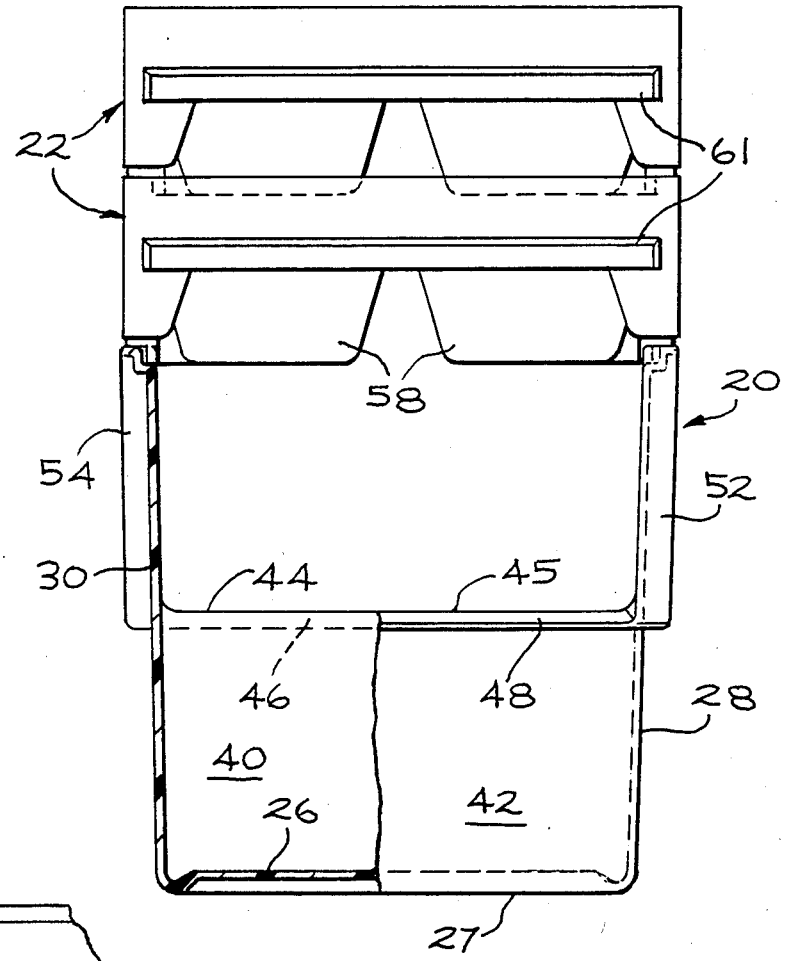
FIG. 4 is an end elevational view partially in section showing the utility container of the present invention with two ice cube trays stacked on top of the container.

With particular reference to FIGS. 3 and 4, the utility container 20 is shown being utilized in connection with the storage of ice cubes and ice cube trays 22 wherein there is shown supported on top of the container 20 a single ice cube tray 22 (FIG. 3) or two stacked ice cube trays (FIG. 4). The ice cube trays are identical and normally have a plurality of ice cube cavities to hold water for freezing and forming ice cubes, the outside of which are formed by cavity walls 58 surrounded by a support frame 60 having downwardly directed support legs 62 located at all four corners of the support frame 60. These support legs 62 are seated at the ends of the longitudinal grooves 36 and 38 in the utility container 20. These grooves in cooperation with the support leg 62 prevent side-to-side movement of the ice cube tray 22 when in the upright position as shown in FIG. 3. To prevent back-to-front movement of the ice cube trays relative to the container the longitudinal grooves 36 and 38 terminate at each end thereof a short distance from each end of the side walls 28 and 30 respectively. With this cooperative structural arrangement between the support legs 62 of the ice cube tray 22 and the grooves 36 and 38 in the side walls 28 and 30 respectively, relative movement between the ice cube tray and the container 20 is resisted. As is common practice, the ice cube trays 22 have a configuration including the support frame 60 and support legs 62 so that one tray may be stacked upon the other for storage purposes as shown in FIGS. 1 and 4. It is contemplated in the use of the utility container 20 for the storage of ice cubes that the trays 22, which are made of flexible plastic material, may have the ice cubes removed by gripping the handle projections 61 at each end of the tray, inverting the ice cube tray and twisting it slightly so that the ice cubes free themselves from the cavities of the tray and drop into the container 20. The user then usually fills the tray with water and places the tray 22 upright on top of the container 20 as shown in FIG. 3 and if desired a second tray may also be stored on top of the first tray by nesting a second tray on top of the first tray as shown in FIG. 4. It will be understood that the distance the end walls 40 and 42 extend up the side walls 28 and 30 will depend on the height of the side walls. The end walls should be high enough to store a sufficient quantity of ice cubes in the container without spilling out of the container, yet accommodate easy access to the stored items through the openings between the terminal ends 44 and 45 of the end walls 40 and 42 and the ice tray 22 placed on top of the container. The preferred container and ice cube tray assembly arrangement is shown in FIGS. 3 and 4. It has been found that with this structural arrangement of the container with the ice cube tray placed on top the container and because the container is open at both ends, there are good air flow characteristics which provide convective heat transfer around and underneath the ice cube tray so that the water in the tray cavities freezes more quickly and therefore the ice cube production rate is increased substantially over other arrangements which do not have openings at both ends of the container 20. It has also been found that with the corrugations 26 in the bottom wall 24 of the container that the ice cubes are seated irregularly on the bottom wall and have less surface-to-surface contact with each other so that the tendency of the ice cubes to stick together is reduced.

Figure 5:
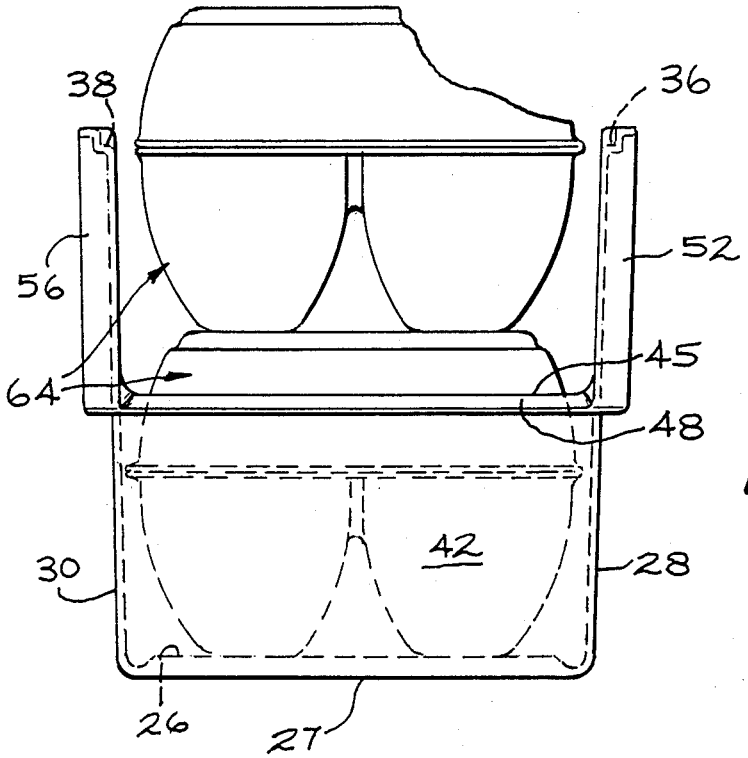
FIG. 5 is an end elevational view showing the utility container of the present invention utilized for the storage of two one-dozen egg cartons.

To accommodate the dual function of the utility container 20 wherein instead of using the container for the storage of ice cubes the user desires to utilize the container for storage of eggs in the fresh food compartment of the refrigerator, the dimensions of the container are such that they will receive a one-dozen egg carton 64 within the container supported on the bottom wall 24 as shown in FIG. 5. This means that the length and width of the container 20 is slightly larger than the dimensions of one-dozen egg cartons that are utilized in transporting small to extra-large chicken eggs. The depth of the container is such that two one-dozen egg cartons may be stored therein, one on top of the other as shown in FIG. 5. If desired, the user may remove the eggs from the egg cartons and place them on the bottom wall 24 for storage. In this case the corrugations 26 function to help keep the eggs separated to allow the flow of cold air around the eggs for better storage conditions of the eggs in the fresh food compartment.

The foregoing is a description of the preferred embodiment of the invention and it should be understood that variations may be made thereto without departing from the true spirit of the invention as defined in the appended claims.

What is claimed is:

1. A container and ice cube tray assembly for storage of ice cubes in a refrigerator freezer compartment, said container comprising:

a bottom wall, two spaced apart walls each having a top portion and a bottom portion, said bottom portion being integrally connected to the bottom wall and the top portion terminating in an outwardly directed top flange, said side wall and flange forming a junction, two spaced apart end walls, said end walls integrally connected to the bottom and side walls and terminating approximately mid-point up the side walls to allow user manual access through either end of the container to ice cubes stored in the container, and an ice cube tray having a plurality of ice cube cavities surrounded by a support frame having downwardly directed support legs, said support legs and the side wall top flanges cooperating to support the ice cube tray in an upwardly facing position.

2. The container and ice cube assembly of claim 1 wherein the bottom wall is corrugated.

3. The container and ice cube tray assembly of claim 1 wherein located near the junction of the side walls and outwardly directed top flanges are grooves, said grooves terminating a short distance from each end of the side walls and the tray support legs have projections received in said grooves to resist relative movement between the ice cube tray and the container.

4. The container and ice cube tray assembly of claim 3 wherein the grooves are at the junction of the side walls and outwardly directed flanges.

5. The container and ice cube tray assembly of claim 1 wherein the end walls terminate in an outwardly directed flange.

6. The container and ice cube tray assembly of claim 5 wherein the side walls have outwardly directed flanges connecting the end wall flanges and the top flanges of the side walls to rigidify the container.

7. The container and ice cube tray assembly of claim 6 wherein the flanges connecting the end wall flanges to the top flanges of the side walls are upwardly and inwardly directed from the end wall flanges.

* * * * *

UNITED STATES PATENT AND TRADEMARK OFFICE

CERTIFICATE OF CORRECTION

PATENT NO. : 4,789,130

DATED : December 6, 1988

INVENTOR(S) : Richard A. Stich and William J. Armstrong

It is certified that error appears in the above-identified patent and that said Letters Patent is hereby corrected as shown below:

Column 4, Claim 2, line 40, after "cube" insert --tray--.

Signed and Sealed this

Twenty-first Day of March, 1989

*Attest:*

*Attesting Officer*

DONALD J. QUIGG

*Commissioner of Patents and Trademarks*